United States Patent [19]

Kaye

[11] Patent Number: 4,793,017

[45] Date of Patent: Dec. 27, 1988

[54] VIBRATING DRAIN-CLEANING IMPLEMENT

[75] Inventor: Paul S. Kaye, Racine, Wis.

[73] Assignee: Lewisan Products, Inc., Racine, Wis.

[21] Appl. No.: 129,456

[22] Filed: Dec. 7, 1987

[51] Int. Cl.[4] ..... B08B 9/02

[52] U.S. Cl. ..... 15/104.33

[58] Field of Search ..... 15/104.31, 104.33; 254/134.3 FT; 242/54

[56] References Cited

U.S. PATENT DOCUMENTS 2,488,490 11/1949 Buchmiller ..... 15/104.33

2,910,158 10/1959 Meyer ..... 15/104.33

4,317,247 3/1982 Levine ..... 15/104.33

*Primary Examiner*—Edward L. Roberts

*Attorney, Agent, or Firm*—Peter N. Jansson, Ltd.

[57] ABSTRACT

A drain-cleaning implement of the type with a rotatable snake extendable for drain insertion. The device includes a mechanism for imparting vibratory motion to the snake at a frequency greater than the rate of rotation such that the snake will more readily pass traps and other obstacles in the drain. The vibration is preferably axial with respect to the snake length. The vibration preferably is actuated during use by applying axial pressure on the snake.

21 Claims, 3 Drawing Sheets

VIBRATING DRAIN-CLEANING IMPLEMENT

FIELD OF THE INVENTION

This invention is related generally to implements for cleaning drains and, more particularly, to implements for drain-cleaning of the type having rotatable snakes extendable for insertion into drains.

BACKGROUND OF THE INVENTION

Drain-cleaning implements of the type having snakes progressively insertable into clogged drains and the like have been well-known and widely used for many years. As commonly understood and as used herein,"snake" means a lengthy and tightly-wound coil of rigid wire or the like.

Many variations of such devices have been used and many improvements developed over the years. Many such implements have electric motors or other power sources to rotate a snake around the axis defined along its length. Such motors are in some cases supported in a base unit and in other cases may themselves be part of a portable implement.

Numerous disadvantages and problems are present in devices of the prior art.

One of the principal and most widely-recognized problems of devices of the prior art is that, during progressive insertion of such snakes into a drain, their lead ends encounter difficulty in passing through the traps within the drains or other obstacles in the drain. Nearly all operators of such implements have experienced situations in which the snake has to be jiggled, rotated, shaken, and withdrawn and reinserted many times in order to pass the drain trap.

Such insertion problems occur even though continued insertion of the snake and unclogging of the drain may be an easy matter after the trap or some other early structural obstacle has been passed.

The implements of the prior art have a number of other problems and shortcomings as well.

Many of such prior devices are very complex in structure and very unwieldy in operation. They are difficult to hold and manipulate during drain-cleaning operations, often requiring two hands and requiring complex manipulations for progressive insertion of the snakes into the drains. The drive mechanisms of some of such prior devices are complex, structurally unsound, and/or prone to breakdown.

The drive mechanisms of such prior devices often provide insufficient torque during startup, which can lead to stalling and the need to prematurely withdraw the snake from the drain to some extent in order to allow startups. In some devices of the prior art, power-driven parts are unshielded, thus causing a risk of injury during use and imposing operation complications to avoid contact with moving parts.

In short, there has been a long-standing need for an improved portable powered drain-cleaning implement.

OBJECTS OF THE INVENTION

It is an object of this invention to provide an improved portable drain-cleaning implement overcoming some of the problems and shortcomings of the prior art, including those mentioned above.

A principal object of this invention is to provide an improved portable drain-cleaning implement which readily passes drain traps and other similar structural obstacles to proper insertion of a snake.

Another object of this invention is to provide a drain-cleaning implement which may be inserted without manual jiggling or shaking and without repeated withdrawals and reinsertions of the snake in order to pass the drain trap or other structural obstacle.

Another object of this invention is to provide an improved drain-cleaning implement which is simple in structure.

Another object of this invention is to provide an improved drain-cleaning implement which is easily manipulated during operation.

Another object of this invention is to provide an improved drain-cleaning implement may easily be held and manipulated with one hand, even during progressive insertion of the snakes into a drain.

Another object of this invention is to provide an improved drain-cleaning implement which is less prone to breakdown than implements of the prior art.

Another object of this invention is to provide an improved drain-cleaning implement providing good torque during startup and while encountering substantial obstacles, thus avoiding the need to prematurely withdraw the snake from the drain to allow restarts.

Another object of this invention is to provide an improved drain-cleaning implement in which substantially all moving parts are shielded, thus reducing the risk of injury during use and making operation easier.

These and other important objects will be apparent from the descriptions of this invention which follow.

SUMMARY OF THE INVENTION

This invention is an improved drain-cleaning implement of the type with a snake which is rotatable about its axis and extendable for drain insertion, a gripper adjustably secured to the snake and rotatable with the snake, and means to rotate the snake. The invention overcomes certain problems and shortcomings of the prior art, including those mentioned above, and provides important advantages.

The drain-cleaning implement of this invention includes means to impart vibratory motion to the snake at a frequency greater than the rate of rotation, such that the snake will more readily pass traps and other obstacles in the drain, particularly during insertion of the snake into drains.

The vibration-imparting means is preferably a means to impart axial vibrations to the snake, that is, rapid reciprocating movements of the snake in a direction along its length. The drain-cleaning implement preferably has means to actuate and deactuate the vibratory motion imparting means while the snake is rotating by increasing and decreasing, respectively, axial pressure on the snake.

That is, applying force on the extended portion of the snake in a direction into the drain causes actuation of the vibration-imparting means, while releasing or relaxing such force causes deactuation of the vibration-imparting means, all while the snake is being rotated by its rotating means.

In a preferred embodiment, the drain-cleaning implement of this invention has: a non-rotatable collar through which the snake rotatably extends; a first vibratory member secured with respect to the collar, preferably attached t the collar, and having a first vibration-imparting surface; a second vibratory member secured with respect to the gripper, preferably attached to the gripper, and having a second vibration-imparting surface.

In such embodiments, the second vibratory member has its second vibration-imparting surface opposed to the first vibration-imparting surface. The first and second vibratory members are relatively movable between positions of engagement and non-engagement of the first and second vibration-imparting surfaces.

The first vibration-imparting surface is preferably an annular surface facing in one axial direction with a first set of radially-spaced axially-extending teeth, while the second vibration-imparting surface is an annular surface facing in the opposite axial direction with a second set of radially-spaced axially-extending teeth. The teeth of such second set, when the vibration-imparting surfaces are engaged, are alternately engagable on and between the teeth of the first set as the gripper rotates with respect to the collar.

In preferred embodiments, the relative movability of the first and second vibratory members is in an axial direction. This imparts the preferred axial vibrations, as noted above.

Certain preferred embodiments include means to allow relative axial movement of the gripper and collar and to limit such relative axial movement. This provides relative axial movability of the vibratory members between positions of engagement and non-engagement of the vibration-imparting surfaces. Such embodiments include means biasing the gripper and collar to a position of non-engagement of the vibratory embers. Thus, when axial pressure on the snake, as described above, is released or sufficiently relaxed, the biasing means will cause disengagement of the first and second vibration-imparting members.

In certain preferred embodiments of this invention, the gripper includes a forwardly-extending tubular member which has a distal end through which the snake extends, means adjacent to the distal end to clamp the snake in selected axial positions with respect to the tubular member, and means adjacent to the clamp means to secure the second vibratory member non-rotatably about the tubular member in axially-fixed position with respect to the tubular member.

The snake container preferably has a wide back portion which contains the snake and the aforementioned forwardly-extending tubular portion. Such tubular portion is concentric with the wide back portion.

The collar is preferably part of the housing and is around the container. The collar preferably extends concentrically over the forwardly-extending tubular portion of the container. The collar preferably includes an axially-facing annular ledge against which the first vibratory member is secured.

In highly preferred embodiments, the housing has a rear portion rearward of the container and the rotation means comprises a motor, preferably an electric motor of the permanent-magnet type, secured in the rear portion of the housing. A ring gear is secured to the back portion of the container and a pinion gear is secured to the motor and engages the ring gear for high-torque rotation of the container and snake.

In highly preferred embodiments, a shaft is secured to the back portion of the container and extends in a rearward direction from it. A receptacle which is affixed to or integral with the rear portion of the housing slidably and rotatably receives the shaft. A compression spring between the rear portion of the housing and the shaft biases the shaft and the container to a forward position. The provides the relative axial movability of the vibratory members between positions of engagement and non-engagement of the vibration-imparting surfaces, as described above, with such vibratory members biased to the relative non-engagement position.

In certain preferred embodiments, the rear portion of the housing has a handle with a trigger switch mounted adjacent to it. This allows the vibratory members to be axially relatively movable toward the engagement position by application of axial pressure on the snake through the handle.

DETAILED DESCRIPTIONS OF PREFERRED EMBODIMENTS

Figure 1:
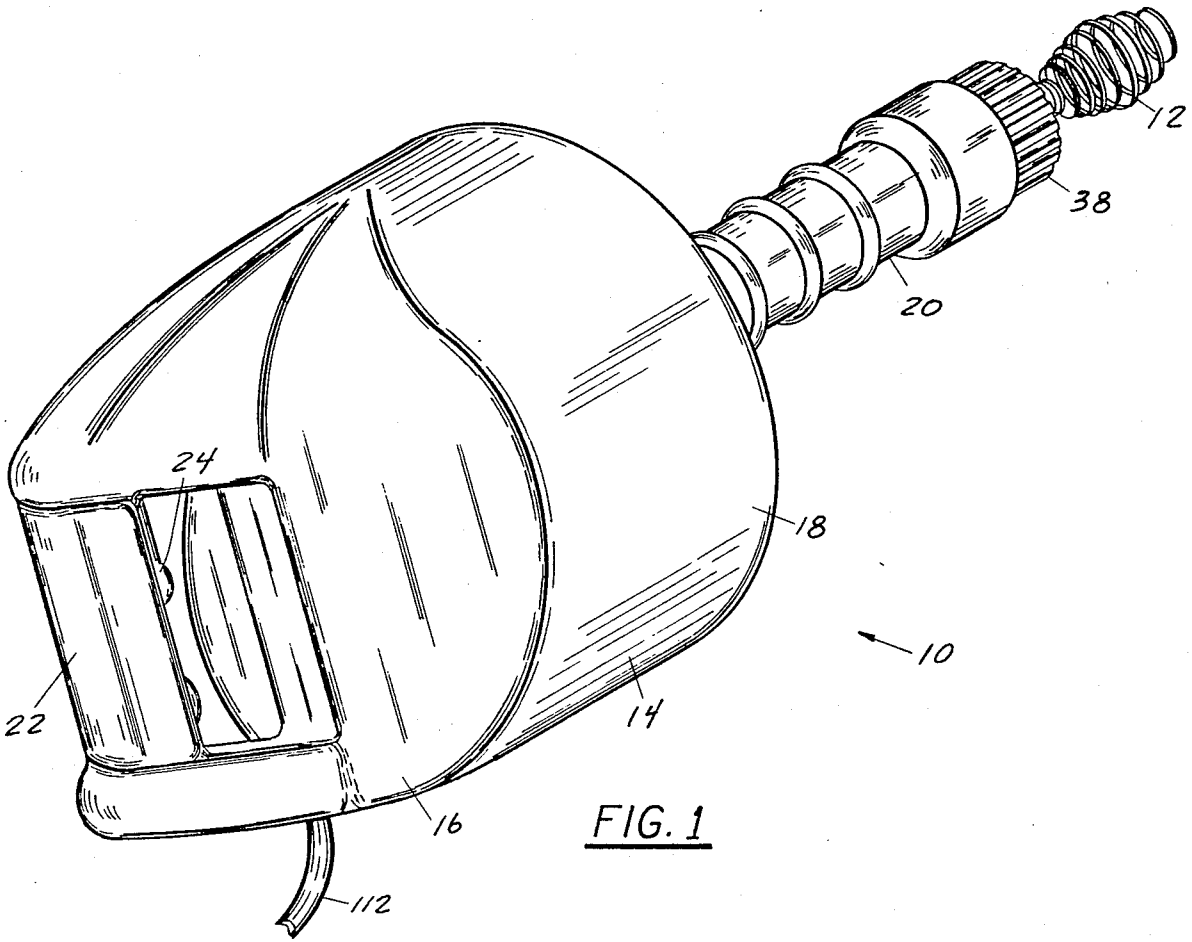
FIG. 1 is a perspective view of an improved drain-cleaning implement in accordance with this invention.

The figures illustrate a drain-cleaning implement 10 in accordance with this invention. Drain-cleaning implement 10 is of the type including a snake 12 which is rotatable about its axis and extendable for insertion into a drain, a gripper which is adjustably secured to the snake and rotatable with the snake, and a means to rotate the snake for drain cleaning purposes.

Drain cleaning implement 10 includes a housing 14 having a rear portion 16 and a front portion 18. Housing 14 substantially covers all moving parts of drain-cleaning implement 10 except for portions immediately at the forward end thereof from which the snake extends. Housing front portion 18 terminates forwardly in a tubular collar 20.

Housing rear portion 16 includes handle 22 which is integrally formed therewith. A trigger switch 24 is mounted to rear portion 16 of housing 14 in a position immediately adjacent to handle 22, allowing drain-cleaning implement 10 to be readily and easily held and operated with one hand.

Container 26 is rotatably supported within front portion 18 of housing 14. Container 26 has a wide back portion 28 which contains most of snake 12 and a forwardly-extending tubular portion 30 which extends concentrically through collar 20 and terminates in distal opening 32 through which snake 12 exits container 26.

Snake 12, which is a tightly wound coil of rigid metal wire, as is well known in the drain cleaning art, has a major portion 34 which, as already noted, is wound in loops confined within back portion 28 of container 26. Snake 12 also includes an unwound portion which extends through tubular portion 30 and out distal opening 32 to terminate in an enlarged drain-insertable distal end 36, as is well known in the art.

The forward end portion of tubular portion 30 has an externally threaded male part on which a finger nut 38 which is adjustably screwed. A collet member 40 is secured at the distal end of tubular portion 30. Collet member 40 has splits in it and an annular tapered outward surface 42 which is engaged by an annular tapered inward surface 44 on finger nut 38. Snake 12 passes through collet member 40 and may be clamped or released by collet member 40 depending upon the position of finger nut 38. This structure provides means adjacent to the forward end portion of tubular portion 30 to clamp snake 12 to tubular portion 30 of container 26, in selected axial positions depending on the length of snake 12 which the operator has pulled from container 26.

Wide back portion 28 of container 26 has a back wall 46 which is secured to container 26 by means of screws 47, or other suitable attachment means. Back wall 46 includes an radially inwardly facing annular surface 48 against which an internally-toothed ring gear 50 is affixed. The attachment of ring gear 50 to back wall 46 is rigid such that container 26 and ring gear 50 rotate as one. Also secured to back wall 46 and extending rearwardly from it in a central position is a shaft 52.

Rear portion 14 of housing 16 has a front wall 54 which is affixed to and parallel to back wall 46. Front wall 54 of housing rear portion 16 has an off-center opening 56. An electric motor 58 of the permanent magnet type is held on place within rear portion 16 of housing 14 by housing features which secure it non-rotatably in fixed off-center position with respect to housing 14 with its motor shaft 60 and a pinion gear 62 mounted thereon extending through opening 56.

Pinion gear 62 is in a position in front of front wall 54. Pinion gear 62, which turns with motor 58, engages gear 50 and imparts a high-torque rotation to ring gear 50 and thus to container 26 and snake 12.

Front wall 54 supports a shaft receptacle 64 in housing rear portion 16. Shaft receptacle 64 rotatably receives shaft 52 and provides means between back wall 46 and front wall 54 for rotatable support of container 26 in fixed concentric position with respect to front wall 54 of housing rear portion 16.

A compression spring 66 extends between shaft 52 and a spring mount 68, which is secured to, preferably integrally formed with, housing rear portion 16. Compression spring 66 biases shaft 52 and container 26 to a forward position. Container 26 is axially movable to a slight extent within housing 14, with compression spring 66 urging container 26 to its forwardmost position.

Housing front portion 18 has a conical annular inside wall 70. Wide back portion 28 of container 26 has a conical annular outside wall 72 which is adjacent to conical inside wall 70. Annular projections 74 extend forwardly from conical outside wall 72 to engage conical inside wall 70 when container 26 is in its forwardmost position. In such position of container 26, annular projections 74 serve as bearings between container 26 and housing 143. Indeed, such contact defines the forwardmost position of container 26.

Back wall 46 of container 26 has an annular projection 76 extending rearwardly in position to engage front wall 54 of housing rear portion 16 when container 26 is in its rearwardmost position. In such position of container 26, annular projection 76 serves as a rotational bearing of container 26 on housing 14.

Figure 2:
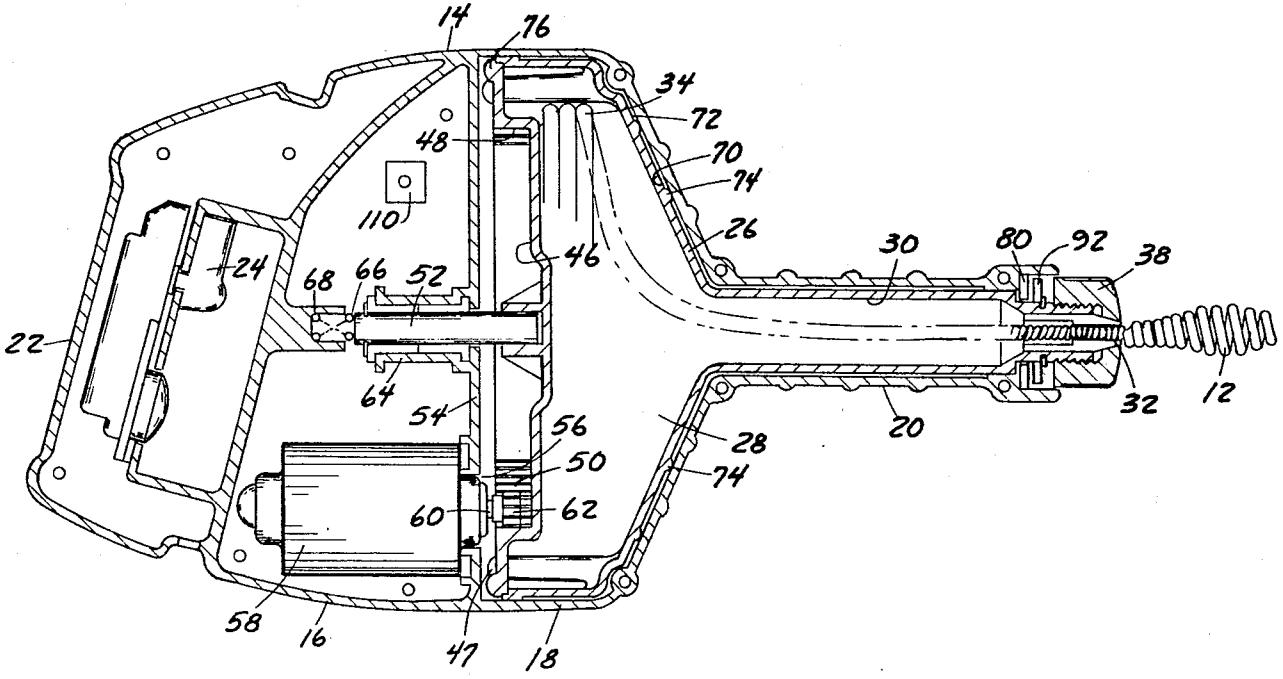
FIG. 2 is a side sectional view.

Electric motor 58 is a 12-volt DC motor of the permanent-magnet type. Motor 58 is powered by 110-volt AC received by means of cable 112 and taken through a bridge rectifier 110, shown in FIG. 2. Electric wiring (not shown) would be apparent to those skilled in the art who are familiar with this invention.

Drain-cleaning implement 10 includes means to impart vibratory motion to snake 12 at a frequency greater than the rate of rotation of container 26 and snake 12. Such vibration allows snake 12 to pass traps and other obstacles in a drain with ease.

Collar 20 includes an axially-facing annular ledge 78. A first vibratory member 80 is non-rotatably secured against annular ledge 78. First vibratory member 80 includes eight flat surfaces 82 shaped to be engaged by complementary characteristics on collar 20, to hold first vibratory member 80 non-rotatably with respect to collar 20. Screws 86 also serve to secure first vibratory member 80 non-rotatably against collar 20.

The distal end of tubular portion 30 of container 26 has a hexagonal portion 88 close to the aforementioned threaded portion on which finger nut 38 is attached. A second vibratory member 92 has a hexagonal opening 94 sized to engage hexagonal portion 88 such that second vibratory member 92 is non-rotatably secured to tubular portion 30.

Figure 3:
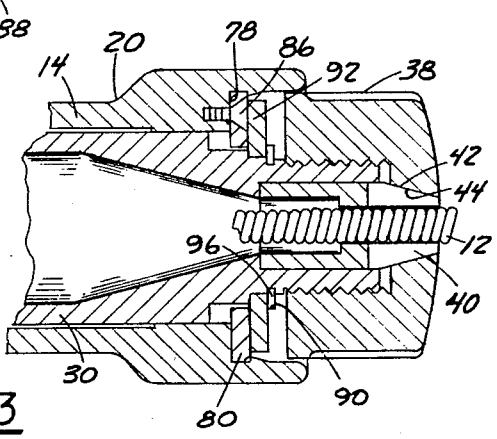
FIG. 3 is a magnified fragmentary view of FIG. 2, illustrating the portion of the implement from which the snake extends.
Figure 4:
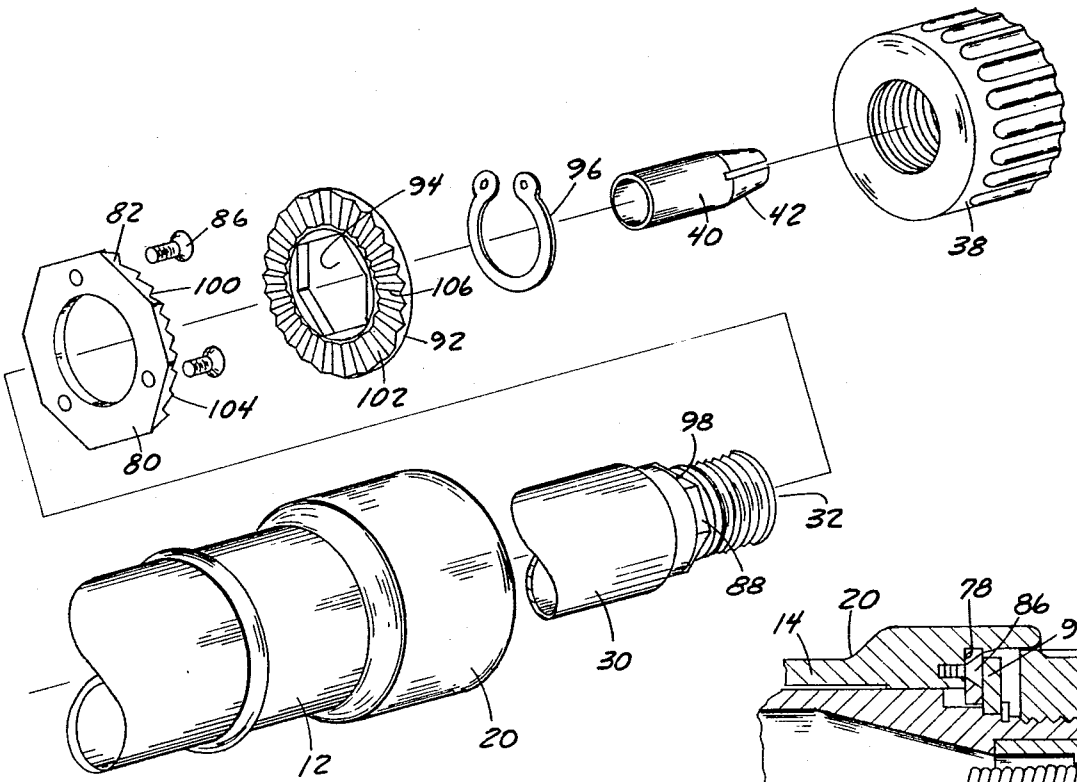
FIG. 4 is an exploded fragmentary perspective view of FIG. 3.

Between hexagonal portion 88 of container tubular portion 30 and the threaded portion is a narrow groove 90. Beyond hexagonal portion 88 is a axially outwardly facing ledge 98. Second vibratory member 92 has an axial dimensions such that it is held in fixed axial position with respect to container tubular portion 30 on hexagonal portion 88, with a snap 96 in groove 90 holding second vibratory member 92 against ledge 98, as shown in FIGS. 3 and 4.

Thus, second vibratory member 92 moves axially only with the movement of container tubular portion 30 and rotates only with the rotation of container tubular portion 30. Stated differently, second vibratory member 92 moves axially and rotates with snake 12 and the gripper elements which engage snake 12.

First vibratory member 80 has a first annular vibration-imparting surface 100 which faces in an outward axial direction. Second vibratory member 92 has a second annular vibration-imparting surface 102 which faces in an inward axial direction, facing first vibration-imparting surface 100.

First and second vibratory members 80 and 92, and their respective vibration-imparting surfaces 100 and 102, are relatively movable with the relative movement of container 26 and collar 20. Such movement is between positions of engagement and non-engagement of the vibration-imparting surfaces 100 and 102.

First and second vibration-imparting surfaces 100 and 102 have radially--spaced axially-extending teeth 104 and 106, respectively. Teeth 104 and 106 are angled so that surfaces 100 and 102 can rotate while in contact.

Teeth 106 of second surface 102 are alternately engagable on and between teeth 104 of first surface 100 as container 26 and its tubular portion 30 rotate with respect to collar 20, when axial pressure has been applied to snake 12 to the extent that surfaces 100 and 102 are engaged. This interaction of teeth 104 and 106 imparts an axial vibration to container 26 and snake 12. Such vibration occurs at a rate which is a multiple of the rotation rate of container 26 and snake 12.

Vibration only occurs when axial pressure has been applied on snake 12, for example as it meets obstacles within the drain to be unclogged. This axial pressure causes container 26 to overcome the biasing force of compression spring 66 such that surfaces 100 and 102 are engaged. When such axial force on snake 12 is relaxed, compression spring 66 will cause disengagement of surfaces 100 and 102, such that rotation of container 26 and snake 12 can continue without vibration. Axial force on snake 12 is supplied by the operator by grasping handle 22 and pushing snake 12 into the drain against an obstacle.

First and second vibratory members 80 and 92 are preferably made of hardened carbon-chromium steel alloys. However, a wise variety of other metals and other hardened materials can b used. Housing 14 is preferably formed from a pair of substantially mirror-image plastic shells which may be secured together by screws or other means well known in the plastics art. Ring gear 50 and pinion gear are preferably nylon gears, but a variety of other materials may be used.

While the principles of this invention have been described in connection with specific embodiments, it should be understood clearly that these descriptions are made only by way of example and are not intended to limit the scope of the invention.

I claim:

1. In a drain-cleaning implement of the type with a non-rotatable frame, a snake container rotatably supported by said frame, a snake rotatable with the snake container about the snake axis and extendable for drain insertion, a gripper adjustably secured to the snake and rotatable therewith, and means to rotate the snake, the improvement comprising means to impart vibratory motion to the snake at a frequency greater than the rate of rotation, said vibratory means including first and second vibratory members secured with respect to the frame and the snake, respectively, each vibratory member having a plurality of projecting means with spaces therebetween said projecting means adapted to be in repeated interrupted contact with each other to repeatedly change the relative positions of the first and second vibratory members as the snake rotates, hereby the snake will more readily pass traps and other obstacles in the drain.

2. The drain-cleaning implement of claim 1 wherein the means to impart vibratory motion includes means to impart axial vibrations to the snake.

3. The drain-cleaning implement of claim 1 having means to actuate and deactuate the vibratory motion imparting means while the snake is rotating by increasing and decreasing, respectively, axial pressure on the snake.

4. In a drain-cleaning implement of the type with a non-rotatable frame, a snake rotatable about its axis and extendable for drain insertion, a gripper rotatably supported with respect to the frame and adjustably secured to the snake and rotatable therewith, and means to rotate the snake, the improvement comprising:

a non-rotatable collar secured with respect to the frame, the snake extending rotatably therethrough;

a first vibratory member secured with respect to the collar and having a first vibration-imparting surface; and a second vibratory member secured with respect to the gripper and having a second vibration-imparting surface opposed to the first vibration-imparting surface, the vibration-imparting surfaces having means thereon adapted to be in contact to repeatedly change the relative positions of the first and second vibratory members as the snake rotates.

5. The drain-cleaning implement of claim 4 wherein the two vibratory members are relatively movable between positions of engagement and non-engagement of their vibration-imparting surfaces.

6. The drain-cleaning implement of claim 5 wherein:

the first vibration-imparting surface is an annular surface facing in one axial direction and the projecting means thereof are a first set of radially-spaced axially-extending teeth; and the second vibration-imparting surface is an annular surface facing in the opposite axial direction and the projecting means thereof are a second set of radially-spaced axially-extending teeth which, when the surfaces are engaged, are alternately engagable on and between the teeth of the first set as the gripper rotates with respect to the collar.

7. The drain-cleaning implement of claim 6 wherein the relative movability of the first and second vibratory members is in an axial direction.

8. The drain-cleaning implement of claim 5 wherein the gripper comprises:

a forwardly-extending tubular member having a distal end through which the snake extends;

means adjacent to the distal end to clamp the snake in selected axial positions with respect to the tubular member; and means adjacent to the clamp means to secure the second vibrator member non-rotatably about the tubular member in axially-fixed position with respect thereto.

9. The drain-cleaning implement of claim 8 comprising a container for the snake, the container having a wide back portion and the forwardly-extending tubular portion.

10. The drain-cleaning implement of claim 9 wherein the non-rotatable collar is part of a housing around the container, the collar extending concentrically over the tubular member.

11. Tee drain-cleaning implement of claim 10 wherein the collar includes an axially-facing annular ledge, the first vibratory member secured thereagainst.

12. The drain-cleaning implement of claim 10 wherein:

the first vibration-imparting surface is a annular surface facing in one axial direction and the projecting means thereof are a first set of radially-spaced axially-extending teeth; and the second vibration-imparting surface is an annular surface facing in the opposite axial direction and the projecting means thereof are a second set of radially-spaced axially-extending teeth which, when the surfaces are engaged, are alternately engagable on and between the teeth of the first set as the gripper rotates with respect to the collar.

13. The drain-cleaning implement of claim 12 wherein the relative movability of the first and second vibratory members is in an axial direction.

14. The drain-cleaning implement of claim 10 wherein:

the housing has a rear portion rearward of the container; and the rotation means comprises a motor secured in the rear portion of the housing.

15. The drain-cleaning implement of claim 14 wherein the rotation means further comprises:

a ring gear secured to the back portion of the container; and a pinion gear secured to the motor and engaging the ring gear for high-torque rotation of the container and snake.

16. The drain-cleaning implement of claim 15 wherein:

the first vibration-imparting surface is an annular surface facing in one axial direction and the projecting means thereof are a first set of radially-spaced axially-extending teeth; and the second vibration-imparting surface is an annular surface facing in the opposite axial direction and the projecting means thereof are a second set of radially-spaced axially-extending teeth which, when the surfaces are engaged, are alternately engagable on and between the teeth of the first set as the gripper rotates with respect to the collar.

17. The drain-cleaning implement of claim 16 wherein the relative movability of the first and second vibratory members is in an axial direction.

18. The drain-cleaning implement of claim 17 further comprising:

a shaft secured to the back portion of the container and extending rearwardly therefrom;

a receptacle on the rear portion of the housing slidably and rotatably receiving the shaft; and a compression spring between the rear portion of the housing and the shaft biasing the shaft and the container to a forward position, thereby providing the relative axial movability of the vibratory members between positions of engagement and non-engagement of the vibration-imparting surfaces, with such vibratory members biased to the non-engagement position.

19. The drain-cleaning implement of claim 18 wherein the rear portion of the housing has a handle with a trigger switch mounted adjacent thereto, whereby the vibratory members are axially relatively movable toward the engagement position by applying axial pressure on the snake through the handle.

20. In a drain-cleaning implement of the type with a snake rotatable about its axis and extendable for drain insertion, a gripper adjustably secured to the snake and rotatable therewith, and means to rotate the snake, the improvement comprising:

a non-rotatable collar, the snake extending rotatably therethrough;

a first vibratory member secured with respect to the collar and having an annular first vibration-imparting surface facing in one axial direction with a first set of radially-spaced axially-extending teeth;

a second vibratory member secured with respect to the gripper and having a second annular vibration-imparting surface facing in the opposite axial direction with a second set of radially-spaced axially-extending teeth;

means allowing and limiting relative axial movement of the gripper and collar to provide relative axial movability of the vibratory members between positions of engagement and non-engagement of the vibration-imparting surfaces;

the teeth of the second set being alternately engagable on and between the teeth of the first set, when the surfaces are engaged, as the gripper rotates with respect to the collar; and means biasing the gripper and collar to a position of non-engagement of the vibratory members.

21. In a drain-cleaning implement of the type with a snake rotatable about its axis and extendable for drain insertion, a container for the snake having a wide back portion and a forwardly-extending tubular portion with a distal end through which the snake extends, gripper means adjacent to the distal end and rotatable with and adjustably secured to the snake to clamp it in selected axial positions with respect to the tubular member, and means to rotate to the snake, the improvement comprising:

a housing around the container having a non-rotatable collar extending concentrically over the tubular portion, which extends rotatably therethrough;

a first vibratory member secured with respect to the collar and having an annular first vibration-imparting surface facing in one axial direction with a first set of radially-spaced axially-extending teeth;

a second vibratory member non-rotatably secured about the tubular member in axially fixed position with respect thereto and having a second annular vibration-imparting surface facing in the opposite axial direction with a second set of radially-spaced axially-extending teeth;

means allowing and limiting relative axial movement of the gripper and collar to provide relative axial movability of the vibratory members between positions of engagement and non-engagement of the vibration-imparting surfaces;

the teeth of the second set being alternately engagable on and between the teeth of the first set, when the surfaces are engaged, as the gripper rotates with respect to the collar; and means biasing the gripper and collar to a position of non-engagement of the vibratory members.

* * * * *

UNITED STATES PATENT AND TRADEMARK OFFICE

CERTIFICATE OF CORRECTION

PATENT NO. : 4,793,017

DATED : December 27, 1988

INVENTOR(S) : Paul S. Kaye

It is certified that error appears in the above-identified patent and that said Letters Patent is hereby corrected as shown below:

Column 2, line 66, change "t the" to --to the--.

Column 4, line 1, change "The" to --This--.

Column 4, line 61, delete "which".

Column 5, line 9, change "an radially" to --a radially--.

Column 5, line 19, change "on" to --in--.

Column 5, line 50, change "143" to --14--.

Column 6, line 18, change "a axially" to --an axially--.

Column 6, line 45, change "radially--spaced" to --radially-spaced--.

Column 7, line 3, change "wise" to --wide--.

UNITED STATES PATENT AND TRADEMARK OFFICE

CERTIFICATE OF CORRECTION

PATENT NO. : 4,793,017

DATED : December 27, 1988

INVENTOR(S) : Paul S. Kaye

It is certified that error appears in the above-identified patent and that said Letters Patent is hereby corrected as shown below:

Column 7, line 4, change "b used" to --be used--.

Claim 1, line 16, change "hereby" to --whereby--.

Claim 8, line 9, change "vibrator" to --vibratory--.

Claim 12, line 3, change "a annular" to -- annular--.

Signed and Sealed this

Second Day of May, 1989

*Attest:*

*Attesting Officer*

DONALD J. QUIGG

*Commissioner of Patents and Trademarks*